US010090577B2

(12) United States Patent
Kashiwagi

(10) Patent No.: US 10,090,577 B2
(45) Date of Patent: Oct. 2, 2018

(54) DATA COMMUNICATION DEVICE

(71) Applicant: KABUSHIKI KAISHA TOSHIBA, Minato-ku, Tokyo (JP)

(72) Inventor: Ippei Kashiwagi, Ome Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 0 days.

(21) Appl. No.: 15/359,507

(22) Filed: Nov. 22, 2016

(65) Prior Publication Data

US 2017/0149117 A1 May 25, 2017

(30) Foreign Application Priority Data

Nov. 24, 2015 (JP) ..... 2015-228911

(51) Int. Cl.
*H01Q 1/48* (2006.01)
*H01Q 1/22* (2006.01)
*H01Q 1/50* (2006.01)

(52) U.S. Cl.
CPC ..... *H01Q 1/2266* (2013.01); *H01Q 1/48* (2013.01); *H01Q 1/50* (2013.01)

(58) Field of Classification Search
CPC ..... H01Q 1/2266; H01Q 1/48; H01Q 1/50
USPC ..... 343/702
See application file for complete search history.

(56) References Cited

U.S. PATENT DOCUMENTS

2011/0183721 A1* 7/2011 Hill ..... H01Q 1/243 455/566

FOREIGN PATENT DOCUMENTS

JP 2000-151267 A 5/2000
JP 3170216 U 9/2011

* cited by examiner

*Primary Examiner* — Andrea Lindgren Baltzell
(74) *Attorney, Agent, or Firm* — Rutan & Tucker, LLP

(57) ABSTRACT

According to one embodiment, a data communication device includes a housing and an antenna. The housing includes a base formed of a carbon material and circumferential edges continuous with edges of the base and formed of a resin material. The antenna is accommodated in the housing and includes a conductive portion grounded via the base and an element portion arranged further away from the base than the conductive portion.

12 Claims, 5 Drawing Sheets

DATA COMMUNICATION DEVICE

CROSS-REFERENCE TO RELATED APPLICATIONS

This application is based upon and claims the benefit of priority from Japanese Patent Application No. 2015-228911, filed Nov. 24, 2015, the entire contents of which are incorporated herein by reference.

FIELD

Embodiments described herein relate generally to a data communication device comprising a housing formed of a carbon material such as carbon-fiber-reinforced plastic (CFRP) and an antenna accommodated in the housing.

BACKGROUND

Recently, data communication devices comprising housings formed partly or entirely of carbon materials have become widely used. Carbon materials have excellent characteristics of being light and strong. Therefore, it is possible by using a carbon material for the housing of a data communication device to reduce the weight and improve the strength of the data communication device.

For example, there is a case where the housing of a tablet computer comprises a base formed of a carbon material such as CFRP and circumferential edges formed of a resin material such as glass epoxy resin. In this case, a resin material is attached to each of the edges of a stretched, thin plate-like carbon material (base). The carbon material and the resin material are integrally attached to each other by gluing or welding.

Here, in the case of attaching a thin metal plate and a resin material to each other, it is possible to increase an attachment strength by providing a projection (anchor) in the metal plate and increasing an attachment area. Therefore, it is possible to easily obtain a desired attachment strength without significantly increasing a portion (overlapping portion) of the metal plate and the resin material in which the metal plate and the resin material overlap and become continuous with each other. On the other hand, in the case of a carbon material, it is difficult to perform fine processing such as processing into a thin plate having a projection (anchor) as compared to the metal plate. Therefore, to increase the attachment strength of a thin plate-like carbon material and a resin material, an overlapping portion greater than that of the case of a metal plate is required. That is, a housing comprising a base formed of a carbon material will have circumferential edges more expanded than those of a housing formed of a metal material for overlapping portions, and thus the housing is likely to have dead spaces.

In a thin tablet computer, built-in components such as a battery and a communication module take up the edges of the tablet computer, that is, up to the vicinity of the overlapping portions. Further, it is also necessary to provide components such as a wireless LAN antenna away from a carbon material having high conductivity so that the antenna performance will not be affected by the carbon material. Therefore, in a housing comprising a base formed of a carbon material, it is necessary to use circumferential edges including overlapping portions effectively for arranging an antenna. Note that, in the case of providing an antenna on a base formed of a carbon material, for example, processing such as forming a notch in a portion of the base overlapping the antenna is necessitated in consideration of the influence of the base on antenna performance. In this case, there is a possibility that the processing will weaken and spoil the appearance of the housing.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings. In general, according to one embodiment, a data communication device comprises a housing and an antenna. The housing comprises a base formed of a carbon material and circumferential edges continuous with edges of the base and formed of a resin material. The antenna is accommodated in the housing and comprises a conductive portion grounded via the base and an element portion arranged further away from the base than the conductive portion.

Data communication devices of certain embodiments will be described hereinafter with reference to FIGS. 1 to 10, but the following description will be based on the assumption that data communication devices of the embodiments are tablet computers.

Figure 1:
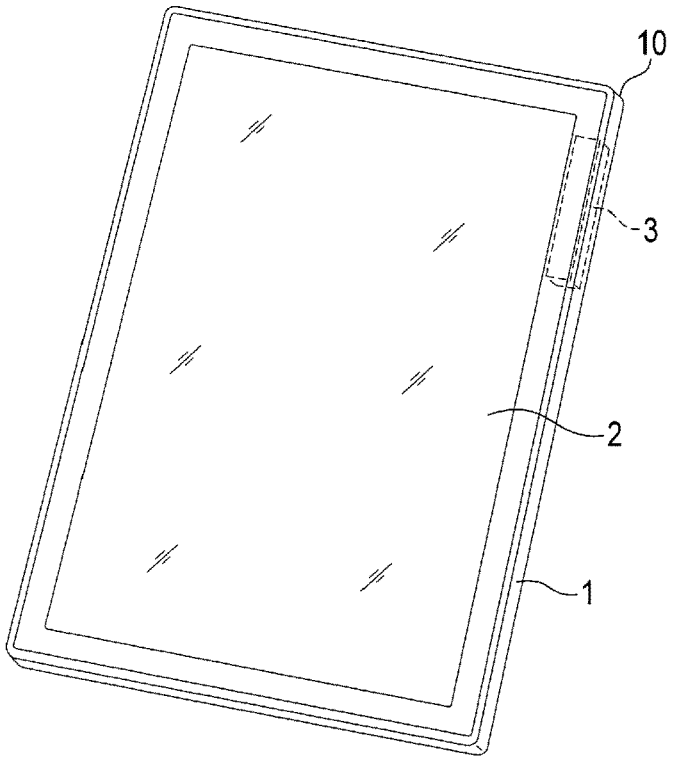
FIG. 1 is an overall perspective view of a data communication device (tablet computer) of the first embodiment.

FIGS. 1 to 6 show the structures of a tablet computer 10 of the first embodiment and its components. As shown in FIG. 1, the tablet computer 10 comprises a housing 1 and a panel 2. In the housing 1, various components (not shown) such as a CPU, a battery and a communication module are accommodated. The panel 2 is set in the opening of the housing 1 and functions as a display configured to display a processing result and the like and also functions as an operator configured to perform an input operation and the like.

Figure 2:
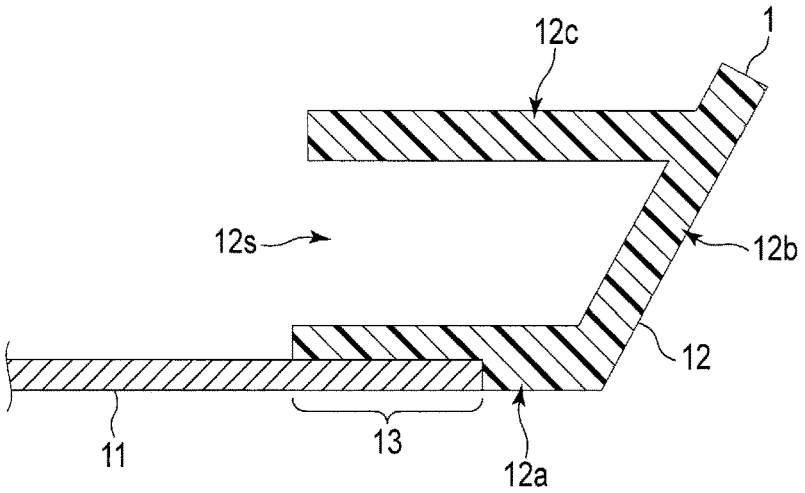
FIG. 2 is a sectional view showing the structure of a housing of the data communication device of the first embodiment.

As shown in FIG. 2, the housing 1 is in the shape of a box consisting of a substantially rectangular base 11 and circumferential edges 12 formed continuously from the edges of the base 11. The base 11 is formed of a carbon material. As the material for the base 11, carbon-fiber-reinforced plastic (CFRP) is used as an example, but another carbon material can also be used. On the other hand, the circumferential edges 12 are formed of a resin material. As the material for the circumferential edge 12, glass epoxy resin is used as an example, but another resin material can also be used. The circumferential edge 12 comprises a bottom portion 12*a*, a side portion 12*b* and a top portion 12*c* all having flat plate-like shapes. The bottom portions 12*a* are continuously formed from the edges of the base 11 in such a manner that the base 11 is completely edged with the bottom portions 12*a*. The side portions 12*b* continuously rise from the bottom portions 12*a* and constitute the sidewalls of the housing 1. The top portions 12*c* are continuously formed from the side portions 12*b*, extend parallel to the bottom portions 12*a*, and constitute the top walls of the housing 1. In this way, a space 12*s* surrounded by the bottom portions 12*a*, the side portions 12*b* and the top portions 12*c* of the circumferential edges 12 is formed at the edges of the housing 1 (in other words, around the base 11).

The base 11 and the circumferential edge 12 overlap with each other in a continuous portion (hereinafter referred to as an overlapping portion) 13 in a state where the base 11 is outside (the side opposite to the side on which various components are accommodated), and the base 11 and the circumferential edge 12 are thereby integrated with each other. In this case, the base 11 is made thinner than the circumferential edge 12, and the circumferential edge 12 is made thinner inwardly in the overlapping portion 13 (a part of the bottom portion 12*a*). Further, the base 11 and the bottom portion 12*a* are connected to each other in such a manner as to overlap with each other in a state where the bottom portion 12*a* is arranged inside and the base 11 is arranged outside. As the connecting method, any method such as gluing or welding may be used. Alternatively, it is also possible to form the base 11 and the circumferential edge 12 integrally by insert molding or the like. In the outer surface of the housing 1, the base 11, the overlapping portion 13 and the circumferential edge 12 are substantially leveled with each other.

As shown in FIG. 1, as one of the components, a radio antenna 3 is accommodated in the housing 1. In the present embodiment, the antenna 3 is accommodated in the space 12*s* of the housing 1. When the antenna 3 is arranged in this way, the CPU, the battery, the communication module and the like can be arranged more inwardly and accommodated within the edges of the housing 1, and thus the thickness or the size of the tablet computer 10 can be easily reduced. FIG. 1 shows a structure in which the antenna 3 is arranged at the upper right corner of the tablet computer 10 as an example, but the antenna 3 may be arranged in any position as long as the antenna 3 is accommodated in the space 12*s* of the housing 1.

As shown in FIGS. 3 to 6, the antenna 3 is a U shape and includes a conductive portion 31, an element portion 32, a short-circuit portion 33, and a thin resin film 34. The element portion 32 is configured to transmit (radiate) and receive a radio signal. The conductive portion 31 and the element portion 32 are connected to each other via the short-circuit portion 33, and the conductive portion 31 functions as a ground for the element portion 32. The conductive portion 31, the element portion 32 and the short-circuit portion 33 are formed of a conductive metal film (such as a copper film or an aluminum film) and are completely covered with the thin resin film 34. That is, the antenna 3 is in the form of a flexible printed circuit (FPC).

Figure 6:
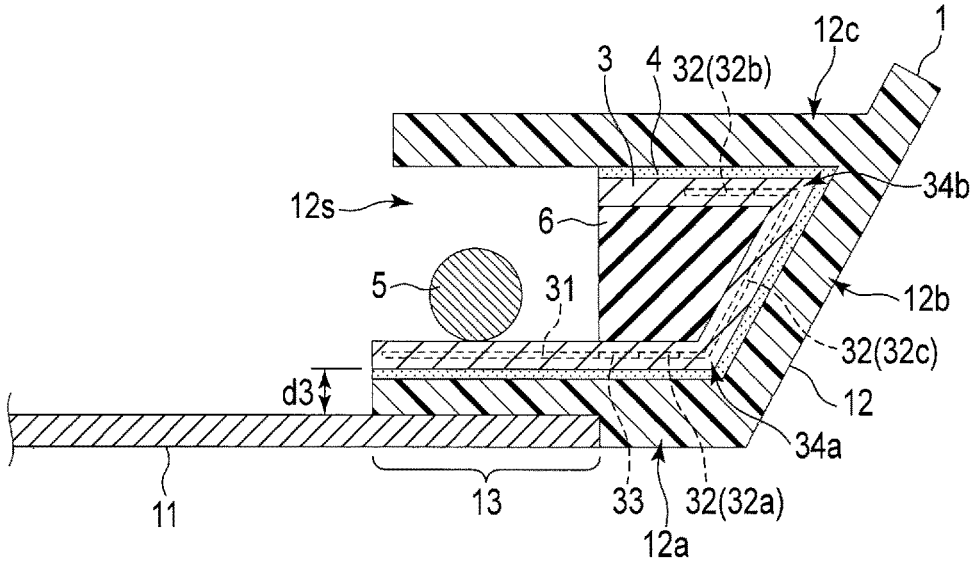
FIG. 6 is a sectional view showing a state where the antenna is secured to the housing of the data communication device of the first embodiment.

The conductive portion 31 is rectangular and is arranged so that the longitudinal axis of the conductive portion 31 is parallel to the edge of the housing 1 and is grounded via the base 11 of the housing 1. In this case, a frequency as high as the operating frequency of the antenna 3 can switch the positive and negative charges in the conductive portion 31 and the base 11 in short cycles. That is, the base 11 (conductive member formed of a carbon material) and the conductive portion 31 are placed in a state as if the base 11 and the conductive portion 31 are electrically coupled to each other. Therefore, in addition to the conductive portion 31, the base 11 can also function as a ground for the antenna 3. Consequently, even if the space 12*s* of the housing 1 includes the overlapping portion 13, as shown in FIG. 6, the antenna 3 can be accommodated in the space 12*s*. Further, even if the antenna 3 is miniaturized, since the base 11 functions as a ground for the antenna 3, desired antenna performance is ensured.

To make the base 11 function as a ground for the antenna 3, the conductive portion 31 is arranged in the continuous portion (overlapping portion 13) of the base 11 and the circumferential edge 12 in such a manner as to be opposed to the base 11 via the circumferential edge 12. That is, the conductive portion 31 overlaps with the continuous portion of the base 11 and the circumferential edge 12 on an axis perpendicular to the inner surface of the base 11. In the overlapping portion 13, the base 11 and the conductive portion 31 are capacitively coupled to each other via the bottom portion 12*a* of the circumferential edge 12. In this way, the base 11 and the conductive portion 31 can function as polar plates and the bottom portion 12*a* can function as a dielectric, and thus the base 11, the conductive portion 31, and the bottom portion 12*a* can constitute a structure similar to that of a capacitor. Therefore, by operating the antenna 3 at high frequencies as described above, it is possible to electrically couple the base 11 and the conductive portion 31 to each other. Note that, as shown in FIG. 6, the antenna 3 is attached to the bottom portion 12*a*, the side portion 12*b* and the top portion 12*c* of the circumferential edge 12 with double-sided adhesive tape 4, and in this way, the antenna 3 is positioned in and secured to the space 12*s*. Note that it is also possible to secure the antenna 3 by gluing or any other method. Further, for example, it is also possible to extend the conductive portion 31 further to the left side of the paper of FIG. 6 and bring the conductive portion 31 in contact with the base 11. In this case, since the carbon material of the base 11 has a non-conductive surface, the conductive portion 31 and the carbon material of the base 11 are not DC coupled but are capacitively coupled to each other.

To have the conductive portion 31 capacitively coupled to the base 11, the dimensions of the conductive portion 31 are set in the following manner. For example, when the antenna 3 is a wireless LAN antenna configured to operate at a frequency of 2400 MHz, the conductive portion 31 preferably has a size (area) greater than about 16 mm×8 mm (area 128 $mm^2$). As an example, the length and the width of the conductive portion 31 are set respectively to about 16 mm (distance d1 shown in FIGS. 4 and 5) and about 8 mm (distance d2 shown therein). However, these dimensions are based on condition that the distance between the conductive portion 31 and the base 11, more specifically, the distance (distance d3 shown in FIG. 6) between the outer surface of the resin film 34 and the inner surface of the base 11 is set to about 0.3 mm and that a dielectric having a dielectric constant of about 4 is provided between the conductive portion 31 and the base 11. Note that the dielectric includes all dielectrics lying between the conductive portion 31 and the base 11 such as the bottom portion 12*a* formed of a resin material and the double-sided adhesive tape 4. In this way, when the antenna 3 is operated on the above-described frequency, it is possible to obtain a resistance required for ground coupling, namely, a resistance of 5Ω or less and thus achieve excellent radiation characteristics in the antenna 3. In this case, the resistance (R) is given by $$R=1/(\Omega C), \quad (1)$$

where Ω is the angular frequency and C is the capacitance of the capacitor, which is given by $$C=\varepsilon S/d, \quad (2)$$

where ε is the dielectric constant, S is the electrode area, and d is the distance between the electrodes.

In equation 2, the electrode area (S) corresponds to the area (d1×d2) of the conductive portion 31, and the distance between the electrodes (d) corresponds to the distance (d3) between the conductive portion 31 and the base 11.

Figure 4:
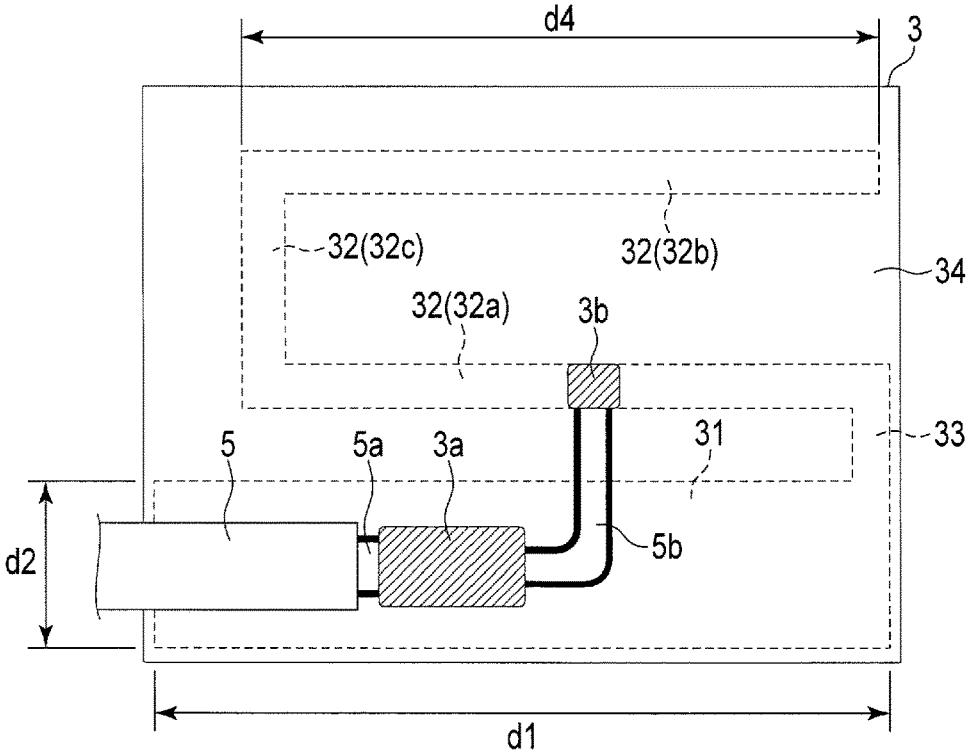
FIG. 4 is a plan view showing the structures of a conductive portion, an element portion and a short-circuit portion of the antenna of the data communication device of the first embodiment.
Figure 5:
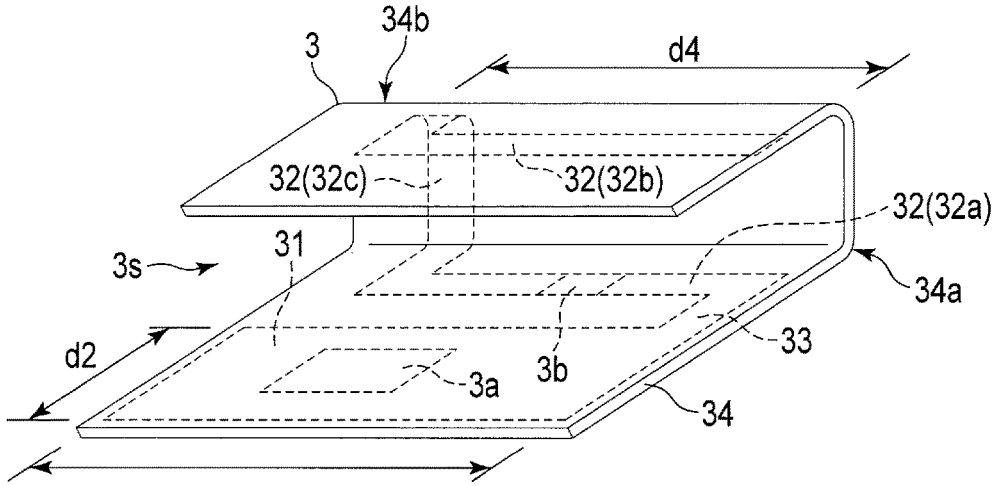
FIG. 5 is a perspective view showing the structures of the conductive portion, the element portion and the short-circuit portion of the antenna of the data communication device of the first embodiment.

As shown in FIGS. 4 and 5, the element portion 32 includes a first element portion 32*a* and a second element portion 32*b* having substantially the same dimensions, arranged parallel to each other, and extending along the longitudinal axis of the conductive portion 31, and the element portion 32 is arranged in such a manner that the longitudinal axes of the first and second element portions 32*a* and 32*b* are parallel to the edge of the housing 1. The first element portion 32*a* is connected to the short-circuit portion 33, and the second element portion 32*b* is connected to the first element portion 32*a* via a connecting portion 32*c*. That is, the element portion 32 is folded back in a length between the short-circuit portion 33 and the connecting portion 32*c*. When the element portion 32 is folded in this way and if, for example, the antenna 3 has a resonant length of a half wavelength (λ/2), the total length of the element portion 32 will be λ/4 or less, and thus each length (distance d4 shown in FIGS. 4 and 5) of the first element portion 32*a* and the second element portion 32*b* can be reduced to λ/8 or less. Therefore, even when the antenna 3 is accommodated in the space 12*s*, it is possible to ensure a radiation area for the antenna 3 by using the space 12*s* most effectively.

Further, as shown in FIGS. 5 and 6, the antenna 3 is bent at both ends of the connecting portion 32*c* of the element portion 32 and extends in the same direction. More specifically, the antenna 3 is bent in such a manner that the antenna 3 extends along the circumferential edge 12 of the housing 1 in a state where the conductive portion 31, the short-circuit portion 33 and the first element portion 32*a* are arranged on the inner surface of the bottom portion 12*a*, the connecting portion 32*c* is arranged on the inner surface of the side portion 12*b*, and the second element portion 32*b* is arranged on the inner surface of the top portion 12*c*, respectively. In this case, the resin film 34 covering the conductive portion 31, the element portion 32 and the short-circuit portion 33 bend in a first bending portion 34*a* and in a second bending portion 34*b*. The first bending portion 34*a* and the second bending portion 34*b* correspond respectively to one end and the other end of the connecting portion 32*c* of the element portion 32.

By bending the antenna 3 in this way, it is possible to reduce the size of the antenna 3 and to fit the antenna 3 perfectly in the space 12*s* of the housing 1 as shown in FIG. 6. Consequently, the element portion 32 is arranged further away via the short circuit portion 33 from an edge portion of the base 11 than the conductive portion 31. In the present embodiment, as shown in FIGS. 5 and 6, the leading end of the antenna 3, namely, the second element 32*b* can be raised with respect to the base 11 (conductive member formed of a carbon material). That is, it is possible to increase the distance between the second element portion 32*b* and the base 11 and thereby easily ensure desired antenna performance.

Note that, in this case, the leading end of the element portion 32, namely, the leading end of the second element portion 32*b* does not overlap with the base 11 (conductive member formed of a carbon material) on the axis perpendicular to the inner surface of the base 11. In addition, the short-circuit portion 33 does not overlap with the base 11 on the axis perpendicular to the inner surface of the base 11, either. That is, the conductive portion 31 of the antenna 3 overlaps with the base 11 in an overlapping portion 13 and the short-circuit portion 33 and the element portion 32 of the antenna 3 do not overlap with the base 11. Thus, the element portion 32 is arranged further away from the overlapping portion 13 of the base 11. Or other words, the element portion 32 is connected to the conductive portion 31 via the short-circuit portion 33 and so is kept apart from contacting the base 11.

The antenna 3 is supplied with power from a coaxial cable 5 in the conductive portion 31 and the element portion 32. As shown in FIGS. 4 and 5, external conductors 5*a* of the coaxial cable 5 are electrically connected to a portion (connecting region 3*a* shown therein) close to the middle of the length of the conductive portion 31 (distance d1 shown therein). In contrast, internal conductors 5*b* of the coaxial cable 5 are electrically connected to a portion (connecting region 3*b* shown in FIGS. 4 and 5) close to the middle of the length of the first element portion 32*a* of the element portion 32 (distance d4 shown therein). That is, connecting region 3*b* is a feed point of the antenna 3. In this way, the antenna 3 is in the form of an inverted-F antenna. The coaxial cable 5 is accommodated in the space 12*s* and arranged along the overlapping portion 13. The base end of the coaxial cable 5 (end opposite to the end which supplies power to the conductive portion 31 and the element portion 32) is electrically connected to a signal output portion (not shown) of the communication module accommodated in the housing 1. On the feeding side of the coaxial cable 5, the external conductors 5*a* are soldered to connecting region 3*a*, while the internal conductors 5*b* are soldered to connecting region 3*b*. The internal conductors 5*b* are bent at a predetermined angle (substantially a right angle in FIG. 4) from connecting region 3*a* of the external conductors 5*a*, and are guided to connecting region 3*b*. In this structure, connecting region 3*b* in which the first element portion 32*a* and the internal conductors 5*b* are electrically connected to each other is completely away from the base 11 (conductive member formed of a carbon material).

Figure 3:
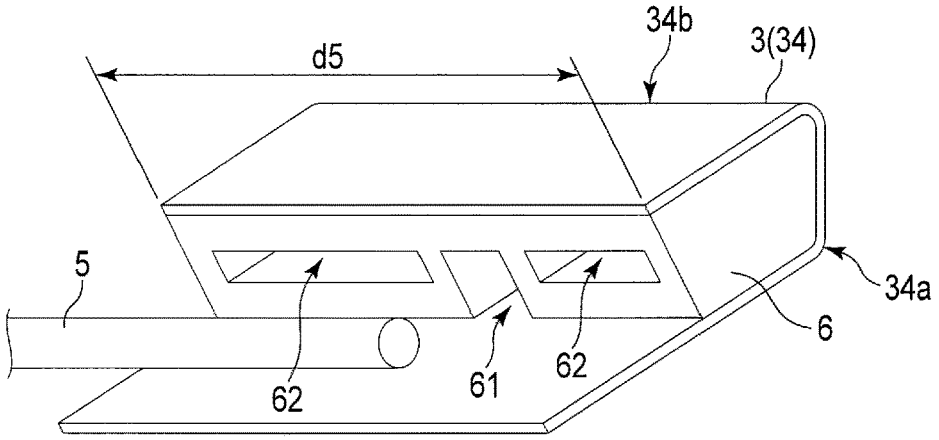
FIG. 3 is a perspective view of an antenna of the data communication device of the first embodiment.

Since the antenna 3 is in the form of an FPC, as described above, the antenna 3 is reinforced by a reinforcing member 6. In the present embodiment, as shown in FIGS. 3 and 6, the antenna 3 is provided on the surfaces of the reinforcing member 6 (in other words, the reinforcing member 6 is held in the antenna 3).

The reinforcing member 6 is a molded-resin member. As the material for the reinforcing member 6, an ABS resin is used as an example, but another resin material can also be used. In the present embodiment, the reinforcing member 6 is molded into such a shape that the element portion 32 of the winding antenna 3 extends along the surfaces of the reinforcing member 6. In other words, the reinforcing member 6 is molded into such a shape as to fill the inner space formed of the winding element portion 32 (more specifically, an inner space 3*s* formed of the resin film 34 shown in FIG. 5). The reinforcing member 6 has a length greater than the length (distance d4) of the element portion 32 and slightly greater than the length (distance d1) of the conductive portion 31. Note that the reinforcing member 6, which reinforces the antenna 3, is provided away from a region in which the conductive portion 31 of the antenna 3 is arranged. Therefore, the coaxial cable 5 can be provided on the conductive portion 31 and arranged along the overlapping portion 13.

The reinforcing member 6 comprises a notch 61 for guiding the internal conductors 5*b* of the coaxial cable 5 to connecting region 3*b* of the first element portion 32*a*. Since connecting region 3*b* is in a portion close to the middle of the length (distance d4) of the element portion 32 (first element portion 32*a*), the notch 61 is formed in a position close to the middle of the length (distance d5 shown in FIG. 3) of the reinforcing member 6. Therefore, the notch 61 will not cause unevenness in the strength of the reinforcing member 6, and thus the reinforcing member 6 can evenly reinforce the antenna 3. Note that cavities 62 are formed on both sides of the notch 61 to reduce the weight of the reinforcing member 6 and prevent the deformation of the reinforcing member 6 at the time of molding. Note that these cavities 62 are not essential.

Figure 7:
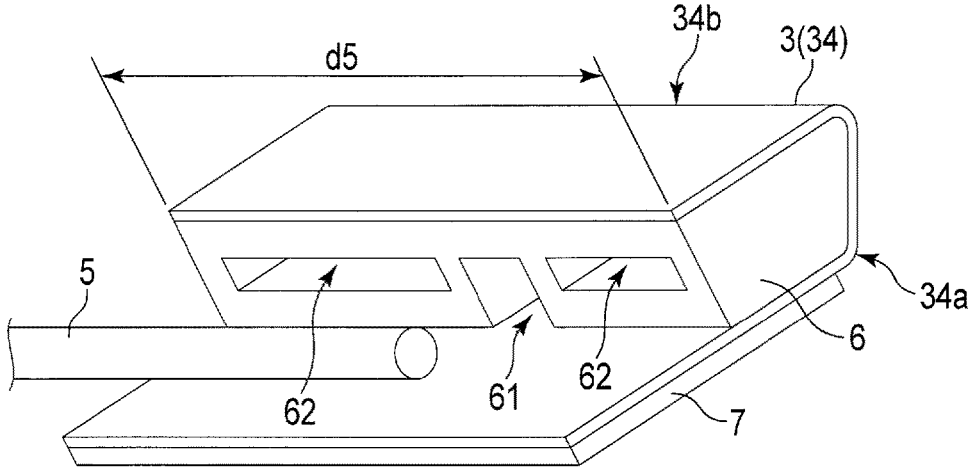
FIG. 7 is a perspective view of an antenna of a data communication device of the second embodiment.
Figure 8:
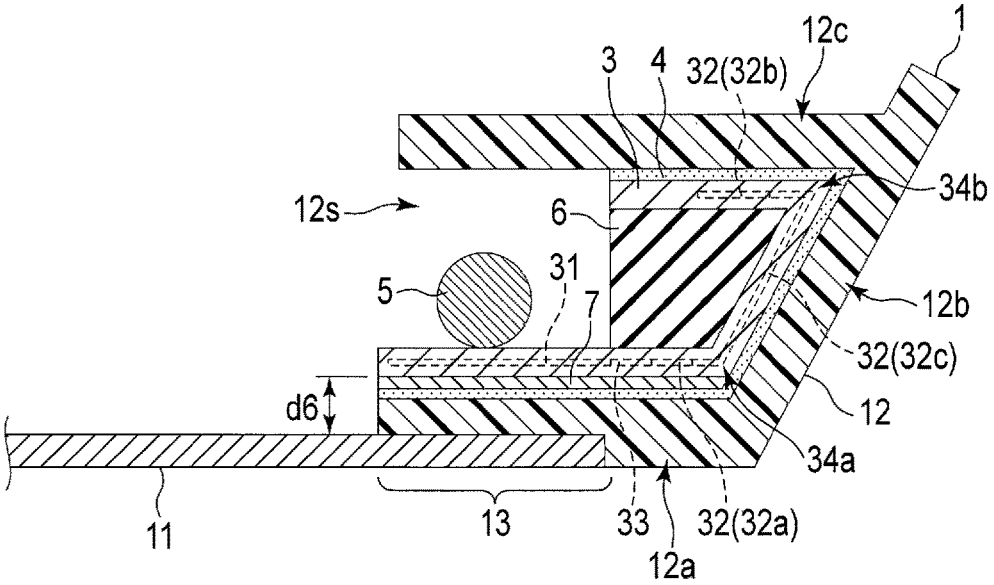
FIG. 8 is a sectional view of a state where the antenna is secured to a housing of the data communication device of the second embodiment.

When the antenna 3 is not sufficiently reinforced by the reinforcing member 6, the antenna 3 may be provided further with a second reinforcing member 7 in addition to the first reinforcing member 6 as shown in FIGS. 7 and 8 of the second embodiment. The second embodiment will be described below. Note that, except for the second reinforcing member 7, the second embodiment is similar to the first embodiment (FIGS. 1 to 6). Therefore, structural members the same as those of the first embodiment will be denoted by the same reference numbers and detailed descriptions thereof will be omitted.

As shown in FIGS. 7 and 8, the second reinforcing member 7 is a plate-like member (reinforcing plate) formed of a resin material. As the material for the second reinforcing member 7, a resin material (dielectric) such as an FR 4 material is used as an example, but another resin material can also be used. In the present embodiment, the second reinforcing member 7 is provided on the side opposite to the side provided with the reinforcing member 6 and on an outer surface of the resin film 34 which covers the conductive portion 31 and the first element portion 32*a*. In the case, the attachment method of the second reinforcing member 7 is not limited to any particular method, but for example, the second reinforcing member 7 may be attached with double-sided adhesive tape or bonded with an adhesive agent. By reinforcing the antenna 3 with the reinforcing member 6 as well as the second reinforcing member 7 in this way, for example, it is possible to prevent breakage of the antenna 3 at the time of transportation and to ensure the strength of the antenna 3 at the time of installation. Consequently, the work efficiency for accommodating the antenna 3 in the housing 1 can be significantly improved. Further, the performance of the antenna having been installed can be stabilized.

Note that the second reinforcing member 7 also functions as a dielectric between the conductive portion 31 and the base 11 together with the bottom portion 12*a* and the double-sided adhesive tape 4. Therefore, in equations 1 and 2 for the resistance (R), the dielectric constant of a dielectric (s) and the distance between electrodes (d) respectively include the dielectric constant and the thickness of the second reinforcing member 7. For this reason, for example, when the antenna 3 is a wireless LAN antenna configured to operate at a frequency of 2400 MHz, in the present embodiment, the dielectric constant (ε) of a dielectric including the dielectric constant of the second reinforcing member 7 is set to about 4. Further, the distance between electrodes (d), that is, the distance (distance d6 shown in FIG. 8) between the conductive portion 31 and the base 11 including the thickness of the second reinforcing member 7 is set to about 0.3 mm. Under these conditions, the conductive portion 31 has a size (area) greater than about 16 mm×8 mm (area 128 $mm^2$). In this way, when the antenna 3 is operated on the above-described frequency, a resistance required for ground coupling, namely, a resistance of 5 Ω or less can be obtained, and thus excellent radiation characteristics can be achieved in the antenna 3.

Figure 9:
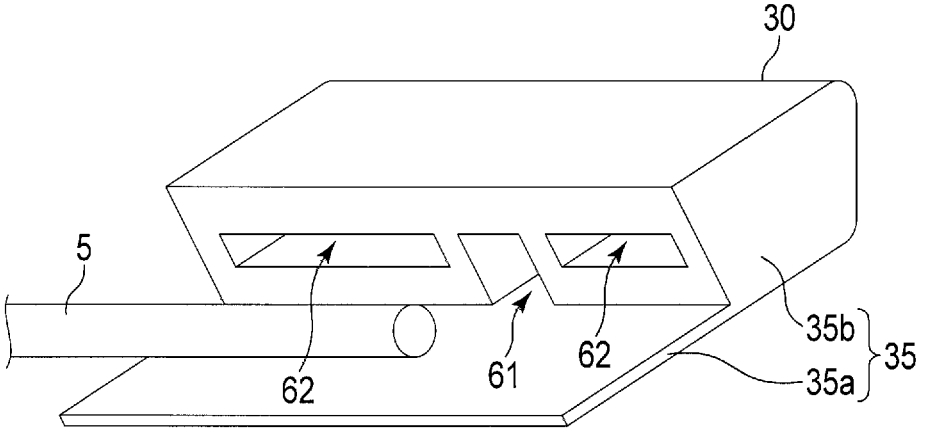
FIG. 9 is a perspective view of an antenna of a data communication device of the third embodiment.
Figure 10:
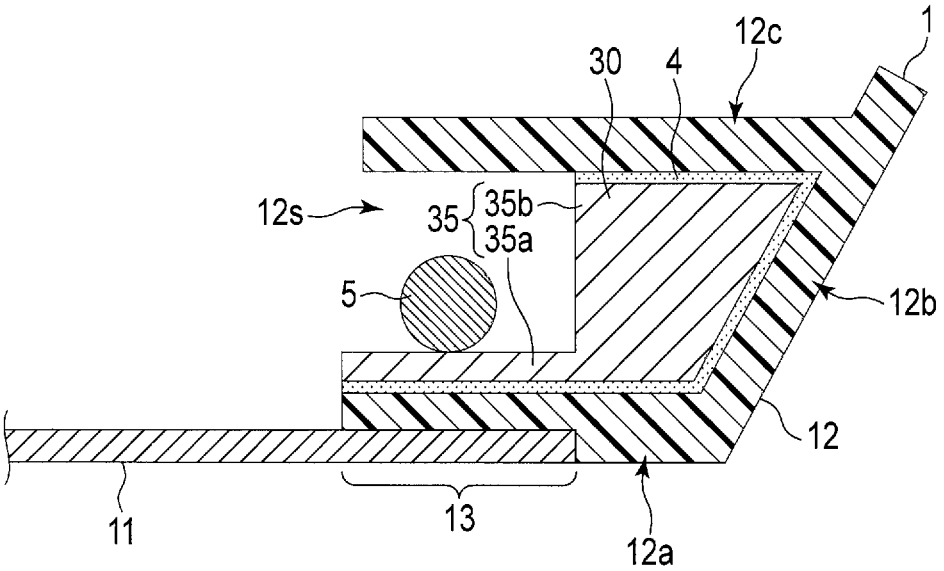
FIG. 10 is a sectional view of a state where the antenna is secured to a housing of the data communication device of the third embodiment.

In the first and second embodiments, the antenna 3 is in the form of an FPC and is reinforced by the reinforcing member 6 and the second reinforcing member 7, but the structure of the antenna 3 is not necessarily limited to those described above. For example, the antenna 3 may comprise a member similar to the reinforcing member 6 as an antenna base and an antenna pattern formed directly on the surface of the antenna base. In FIGS. 9 and 10, an antenna 30 having such a structure is shown as an antenna 30 of the third embodiment. The third embodiment will be described below. Note that, except for an antenna base 35 having an antenna pattern thereon, the third embodiment is similar to the first embodiment (FIGS. 1 to 6). Therefore, structural members the same as those of the first embodiment will be denoted by the same reference numbers and detailed descriptions thereof will be omitted.

FIG. 9 is a perspective view showing the structure of the antenna 30, and FIG. 10 is a sectional view showing a state where the antenna 30 is accommodated in the space 12*s* of the housing 1. The antenna base 35 is formed of a resin material. An ABS resin is used the material for the antenna base 35 as in the case of the reinforcing member 6, but another resin material can also be used.

As shown in FIGS. 9 and 10, the antenna base 35 comprises a first antenna base 35*a* having a flat plate-like shape and a second antenna base 35*b* having six surfaces, one surface of which is continuous with the surface of the first antenna base 35*a*. The first antenna base 35*a* is formed in such a manner as to be arranged along the inner surface of the overlapping portion 13 of the bottom portion 12*a* of the circumferential edge 12 of the housing 1. On the other hand, the second antenna base 35*b* is formed in such a manner that its three surfaces are arranged along the inner surfaces of the bottom portion 12*a*, the side portion 12*b* and the top portion 12*c* of the circumferential edge 12 of the housing 1. Further, on the surface of the first antenna base 35*a*, an antenna pattern (not shown) corresponding to the conductive portion 31, the first element portion 32*a* and the short-circuit portion 33 of the antenna 3 is formed. Still further, on the three surfaces of the second antenna base 35*b*, an antenna pattern (not shown) corresponding to the second element portion 32*b* and the connecting portion 32*c* of the antenna 3 is formed. Although the antenna pattern formation method is not limited to any particular method, for example, a conductive paint may be applied (printed) by laser printing (LDS) or the like in accordance with the antenna pattern. Alternatively, the antenna pattern form of a conductive metal film may be attached.

Note that the second antenna base 35*b* comprises a notch 61 and cavities 62 similar to those of the reinforcing member 6.

Since the antenna base 35 (the first antenna base 35*a* and the second antenna base 35*b*) also serves as a reinforcing member, the antenna 30 is not provided with any reinforcing member in the present embodiment. However, if the antenna 30 does not have a sufficient strength, for example, it is possible to provide a reinforcing member corresponding to the second reinforcing member (resin plate member) 7 of the second embodiment (FIGS. 7 and 8) to reinforce the antenna 30.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A data communication device comprising:

a housing comprising (i) a base formed of a carbon material and (ii) circumferential edges that are continuous with edges of the base, the circumferential edges formed of a resin material, the circumferential edges including a bottom portion, a side portion and a top portion that form an accommodation space, and an antenna accommodated in the accommodation space, wherein the antenna comprises a conductive portion grounded to the base by capacitive coupling via an overlapping portion formed between the base and the circumferential edges, and an element portion connected to the conductive portion via a short-circuit portion and arranged away from the base.

2. The data communication device of claim 1, wherein the element portion comprises a first element portion and a second element portion extending parallel to each other in a longitudinal direction of the conductive portion, and further comprises a connecting portion connecting the first element portion and the second element portion, the first element portion is connected to the short-circuit portion, the conductive portion, the short-circuit portion and the first element portion are arranged along a bottom portion of the circumferential edges, the connecting portion is arranged along a side portion of the circumferential edges, and the second element portion is arranged along a top portion of the circumferential edges.

3. The data communication device of claim 2, wherein the antenna further comprises a coaxial cable connected to the conductive portion and the first element portion for supplying power, and the coaxial cable is arranged along the conductive portion of the overlapping portion.

4. The data communication device of claim 3, wherein the conductive portion comprises a first connecting region, the first connecting region electrically connected to external conductors of the coaxial cable, the first element portion comprises a second connecting region, the second connecting region electrically connected to internal conductors of the coaxial cable, and the second connecting region is a feed point of the antenna.

5. The data communication device of claim 1, wherein a first portion of the base adjacent to the circumferential edges has a first thickness that is thinner than the circumferential edges, and the overlapping portion having a second thickness less than the first thickness.

6. The data communication device of claim 1, wherein the conductive portion, the short-circuit portion and the element portion are formed of a conductive metal film, and the conductive portion, the short-circuit portion and the element portion are covered with a thin film and form a flexible printed circuit.

7. The data communication device of claim 2, wherein a reinforcing member for reinforcing the antenna is provided in a space formed by the short-circuit portion, the first element portion, the connecting portion and the second element portion of the antenna.

8. The data communication device of claim 7, wherein the space is a bent space of the element portion, the first element portion and the second element portion bend in a same direction in a first bending portion at a first end of the connecting portion and a second bending portion at a second end of the connecting portion, and the first and second element portions are arranged along a surface of the reinforcing member.

9. The data communication device of claim 2, wherein the capacitive coupling is realized by causing the base and the conductive portion to function as polar plates and causing the bottom portion of the circumferential edges interposed between the base and the conductive portion to function as a dielectric.

10. The data communication device of claim 8, wherein a leading end of the second element portion extends for a width so as to not overlap with the overlapping portion in a perpendicular direction.

11. The data communication device of claim 4, wherein a reinforcing member for reinforcing the antenna is provided in a space formed by the short-circuit portion, the first element portion, the connecting portion and the second element portion of the antenna, the reinforcing member comprises a notch, and the second connecting region is connected to the coaxial cable wired through the notch.

12. The data communication device of claim 1, wherein the element portion is arranged further away from the base than the conductive portion.

* * * * *